US010214910B1

(12) United States Patent
Inzeo et al.

(10) Patent No.: US 10,214,910 B1
(45) Date of Patent: Feb. 26, 2019

(54) ATTACHMENT OF ROOF EDGE ELEMENTS

(71) Applicant: Metal-Era, Inc., Waukesha, WI (US)

(72) Inventors: Joseph A. Inzeo, West Allis, WI (US); Scott A. Kittilstad, Waukesha, WI (US)

(73) Assignee: METAL-ERA, INC., Waukesha, WI (US)

( * ) Notice: Subject to any disclaimer, the term of this patent is extended or adjusted under 35 U.S.C. 154(b) by 0 days.

(21) Appl. No.: 16/116,995

(22) Filed: Aug. 30, 2018

Related U.S. Application Data

(63) Continuation-in-part of application No. 16/102,873, filed on Aug. 14, 2018, which is a continuation-in-part of application No. 15/846,329, filed on Dec. 19, 2017, which is a continuation-in-part of application No. 15/396,836, filed on Jan. 3, 2017, now Pat. No. 9,874,023.

(51) Int. Cl.
*E04D 13/15* (2006.01)
*E04B 1/38* (2006.01)

(52) U.S. Cl.
CPC ..... *E04D 13/15* (2013.01); *E04B 2001/405* (2013.01)

(58) Field of Classification Search
CPC ..... E04D 13/15; E04B 2001/405
See application file for complete search history.

(56) References Cited

U.S. PATENT DOCUMENTS 4,483,112 A * 11/1984 Rueblinger ..... E04D 13/155 52/58
4,641,476 A * 2/1987 Webb ..... E04D 13/155 52/60
4,759,157 A * 7/1988 Webb ..... E04D 13/155 52/60
7,451,572 B1 11/2008 Inzeo et al.
7,647,730 B1 * 1/2010 Inzeo ..... E04D 13/155 52/300

* cited by examiner

*Primary Examiner* — Andrew J Triggs
(74) *Attorney, Agent, or Firm* — Donald J. Ersler

(57) ABSTRACT

A roof edge mounting bracket preferably includes a base member and a vertical attachment flange. The base member extends outward in a horizontal orientation from the vertical attachment flange. A lower portion of the vertical attachment flange extends below the base member and an upper portion of the vertical attachment flange extends above the base member. The roof edge bracket has a plurality of variations. A canted fascia with roof edge bracket preferably includes an anchor bar, a roof edge bracket, an S-clip, a water dam and a fascia cover. A vertical member of the roof edge bracket and a vertical portion of the water dam are retained in the S-clip. A horizontal portion of the roof edge bracket is secured to a top of a wall. A lengthwise base member of the anchor bar is attached to the vertical portion of the roof edge bracket.

14 Claims, 12 Drawing Sheets

ATTACHMENT OF ROOF EDGE ELEMENTS

CROSS-REFERENCES TO RELATED APPLICATIONS

This continuation in part patent application claims the benefit of patent Ser. No. 16/102,873, filed on Aug. 14, 2018, which claims the benefit of patent application Ser. No. 15/846,329, filed on Dec. 19, 2017, which claims the benefit of patent application Ser. No. 15/396,836, filed on Jan. 3, 2017.

BACKGROUND OF THE INVENTION

Field of the Invention

The present invention relates generally to building trim and more specifically to a roof edge mounting bracket for extended insulation, which may be used when installing roof edge trim to a building and extending insulation over a constructed wall of the building. The canted fascia with roof edge bracket includes a canted fascia adapted for use with a roof edge bracket.

Discussion of the Prior Art

Roof trim is typically mounted to a wood nailer, which is found on a top of a building. Roof trim includes fascias, drip edges, gutters, copings and the like. Sometimes the wood nailer may rot and not be suitable for attachment of the roof trim. Lately, building designers have been using non-wood nailers and multiple layers of insulation. An attachment height of the roof trim to the wood or non-wood nailer would be too low relative to a top of a building with multiple layers of insulation. The multiple layers of added insulation could be as much as 6-8 inches thick or greater. A device is needed to extend upward the attachment point of the roof trim. U.S. Pat. No. 7,451,572 to Inzeo et al. discloses a roof fascia with extension cleat. U.S. Pat. No. 7,647,730 to Inzeo et al. discloses a roof edging system. U.S. Pat. Nos. 7,451,572 and 7,647,730 are hereby incorporated by reference in their entirety. Typically, a wood nailer is attached to a top of a pre-cast concrete wall. Roof trim is then attached to a side of wood nailer with fasteners. It has been found that extending insulation over a top of a pre-cast concrete wall increases insulation efficiency. However, a lower portion of roof trim cannot be reasonably secured to a wood nailer.

Accordingly, there is a clearly felt need in the art for a canted fascia with roof edge bracket, which includes a canted fascia adapted for use with a roof edge bracket.

SUMMARY OF THE INVENTION

The present invention provides a roof edge mounting bracket for extended insulation, which may be used when insulation is extended over a top of a pre-cast concrete wall. A roof edge includes fascias, drip edges, gutters, copings and the like. A roof edge mounting bracket preferably includes a base member and a vertical attachment flange. The base member extends outward in a horizontal orientation from the vertical attachment flange. A lower portion of the vertical attachment flange extends below the base member and an upper portion of the vertical attachment flange extends above the base member. It is preferable that a height of the upper portion is about at least 0.5 inches and the lower portion about 0.5 inches. If multiple layers of insulation are used, the upper portion of the vertical attachment flange will have to be greater than the 0.5 inches. The insulation may be replaced with cover board, or used in conjunction with cover board. The lower portion of the vertical attachment flange may be equal in length, less in length or greater in length than the upper portion of the vertical attachment flange. An angled roof edge bracket includes a base member and a vertical attachment flange. The base member extends from the vertical attachment flange at an acute angle.

A cantilevered roof edge bracket preferably includes a cantilevered base member and a vertical attachment flange. The vertical attachment flange does not make contact with an outer surface of a wall. A portion of the cantilevered base member does not make contact with the wall to provide clearance for a non-supporting decorative panel applied to the outer surface of the wall. Insulation is extended outward to an upper portion of the vertical attachment flange. A fascia bracket is attached to the vertical attachment flange (not shown).

A plurality of staggered fastener openings are formed through the base member. The roof edge mounting bracket is preferably fabricated from an aluminum extrusion, but other materials and manufacturing processes may also be used. The base member is inserted between a top of a nailer and a bottom of an insulation board. The wood nailer is mounted to a top of a corrugated metal deck. The roof edge mounting bracket is secured to a building with a plurality of fasteners inserted through the plurality of fastener openings and the plurality of fasteners screwed into the nailer. However, if the wood nailer is damaged, longer fasteners must be used, which will be screwed into the corrugated metal deck. The roof trim is attached to the top portion of the vertical attachment flange with a plurality of self-tapping fasteners.

A wood nailer is attached to a top of a pre-cast concrete wall. The base member of the roof edge mounting bracket is secured to the top of the wood nailer with a plurality of fasteners. At least one layer of insulation is placed over the existing roof insulation, the wood nailer and the base member. A roof trim may be secured to the upper portion of the vertical attachment flange of the roof edge mounting bracket with a plurality of trim fasteners.

The base member of the roof edge mounting bracket may be secured directly to a top of a pre-cast concrete wall with a plurality of fasteners. At least one layer of insulation is placed over the existing roof insulation, the pre-cast concrete wall and the base member. Roof trim may be secured to the upper portion of the vertical attachment flange of the roof edge mounting bracket with a plurality of trim fasteners.

The base member of the roof edge mounting bracket may be secured directly to a top of a corrugated metal deck with a plurality of fasteners. The corrugated metal deck is attached to a concrete insert in a top of a concrete block with a second plurality of fasteners. At least one layer of insulation is placed over the corrugated metal deck. Roof trim may be secured to the upper portion of the vertical attachment flange of the roof edge mounting bracket with a plurality of trim fasteners.

The base member of the roof edge mounting bracket may be secured to a cap channel, which terminates a top of a plurality of insulation filled metal studs with a plurality of fasteners. At least one layer of insulation is placed over existing roof insulation, the cap channel and the base member. The roof trim may be secured to the upper portion of the vertical attachment flange of the roof edge mounting bracket with a plurality of trim fasteners.

A roof edge angle bracket includes a base member and a vertical attachment flange. The vertical attachment flange extends upward from an end of the base member. The vertical attachment flange does not include a lower portion. A roof edge vertical bracket preferably includes a vertical attachment flange, a bottom offset lip and an upper retaining lip. The bottom offset lip extends from a bottom of the vertical attachment flange. The upper retaining lip extends upward from a top of the vertical attachment flange. The upper retaining lip includes a turned over lip and a clip extension. The clip extension extends from a top of the turned over lip.

A canted fascia with roof edge bracket preferably includes an anchor bar, a roof edge bracket, an S-clip, a water dam and a fascia cover. The anchor bar includes a lengthwise base member, an offset end, a spacer projection and an upper cover retainer. The offset end extends from a bottom of the lengthwise base member. The spacer projection extends outward from an outside surface of the lengthwise base member. The upper cover retainer extends from a top of the lengthwise base member. The upper cover retainer includes a cover groove and a membrane projection. The membrane projection extends downward at an acute angle. The roof edge bracket includes a base member (horizontal member) and a vertical member. The base member extends from the vertical member. The S-clip includes a strip metal bent to form a downward facing pocket, adjacent an upward facing pocket. The water dam includes a base portion, a vertical portion and an angled portion. The vertical portion extends downward from one end of the base portion. The angled portion extends upward from an opposing end of the base portion at an acute angle. The fascia cover includes a fascia base, a bottom clip, a clip extension and an upper clip. The bottom clip extends upward and back from a bottom of the fascia base. One end of the clip extension extends back from a top of the fascia base. The upper clip extends downward and inward from an opposing end of the clip extension.

In use, the vertical member of the roof edge bracket is in inserted into the downward facing pocket of the S-clip. The vertical portion of the water dam is inserted into the upward facing pocket in the S-clip. The horizontal portion of the roof edge bracket is secured to a top of a wall. A roof membrane is laid over the angled portion of the water dam. The membrane projection of the anchor bar is placed over a top of the water dam. The lengthwise base member is attached to the vertical portion of the roof edge bracket preferably with a plurality of fasteners. The fascia cover is attached to the anchor bar by placing the offset edge into the bottom clip. The fascia cover is then rotated to insert the upper clip into the cover groove of the upper cover retainer.

Accordingly, it is an object of the present invention to provide a roof edge mounting bracket, which may be used with a damaged wood nailer to mount roof trim on a building.

It is a further object of the present invention to provide a roof edge mounting bracket, which may be used to extend upward an attachment height of the roof trim.

It is another object of the present invention to provide a roof edge mounting bracket for extended insulation, which may be used when insulation is extended over a top of a pre-cast concrete wall, a concrete block wall, a plurality of insulation filed metal studs or the like.

It is yet another object of the present invention to provide an angled roof edge bracket, which may be attached to a wall.

It is yet another object of the present invention to provide a cantilevered angled roof edge bracket, which is attached to a top of a vertical wall.

It is yet another object of the present invention to provide a roof edge angle bracket, which is attached to a top of a vertical wall.

It is yet another object of the present invention to provide a roof edge vertical bracket, which is attached to an outer surface of a vertical wall.

Finally, it is another object of the present invention to provide a canted fascia with roof edge bracket, which includes a canted fascia adapted for use with a roof edge bracket.

These and additional objects, advantages, features and benefits of the present invention will become apparent from the following specification.

DETAILED DESCRIPTION OF THE PREFERRED EMBODIMENTS

Figure 1:
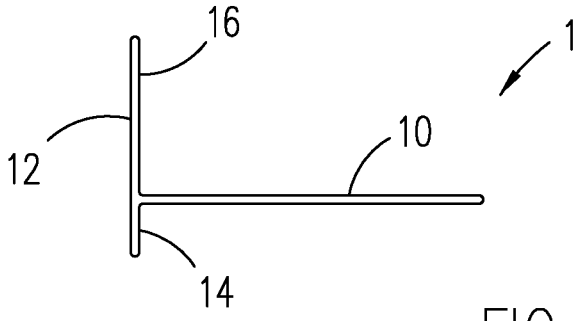
FIG. 1 is an end view of a roof edge mounting bracket in accordance with the present invention.
Figure 2:
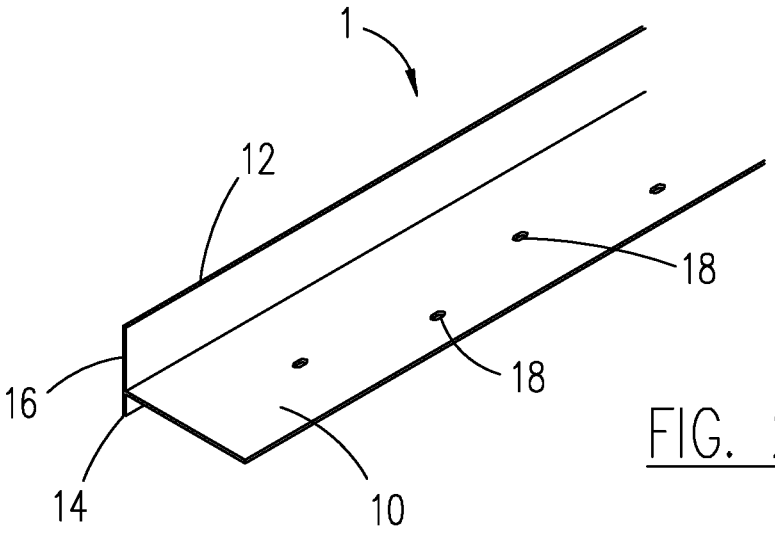
FIG. 2 is a perspective view of a roof edge mounting bracket in accordance with the present invention.
Figure 1A:
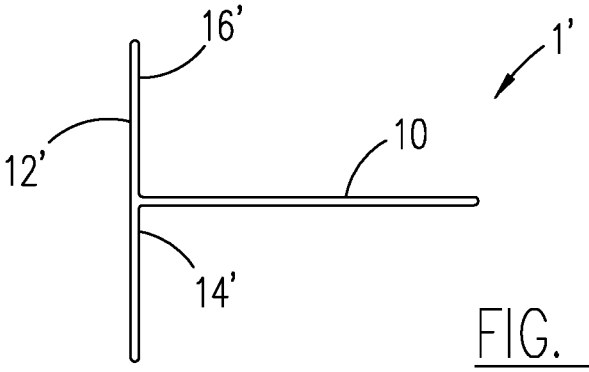
FIG. 1*a* is an end view of a roof edge mounting bracket with a lower portion of a vertical attachment flange, which is equal in length to an upper portion of a vertical attachment flange in accordance with the present invention.
Figure 3:
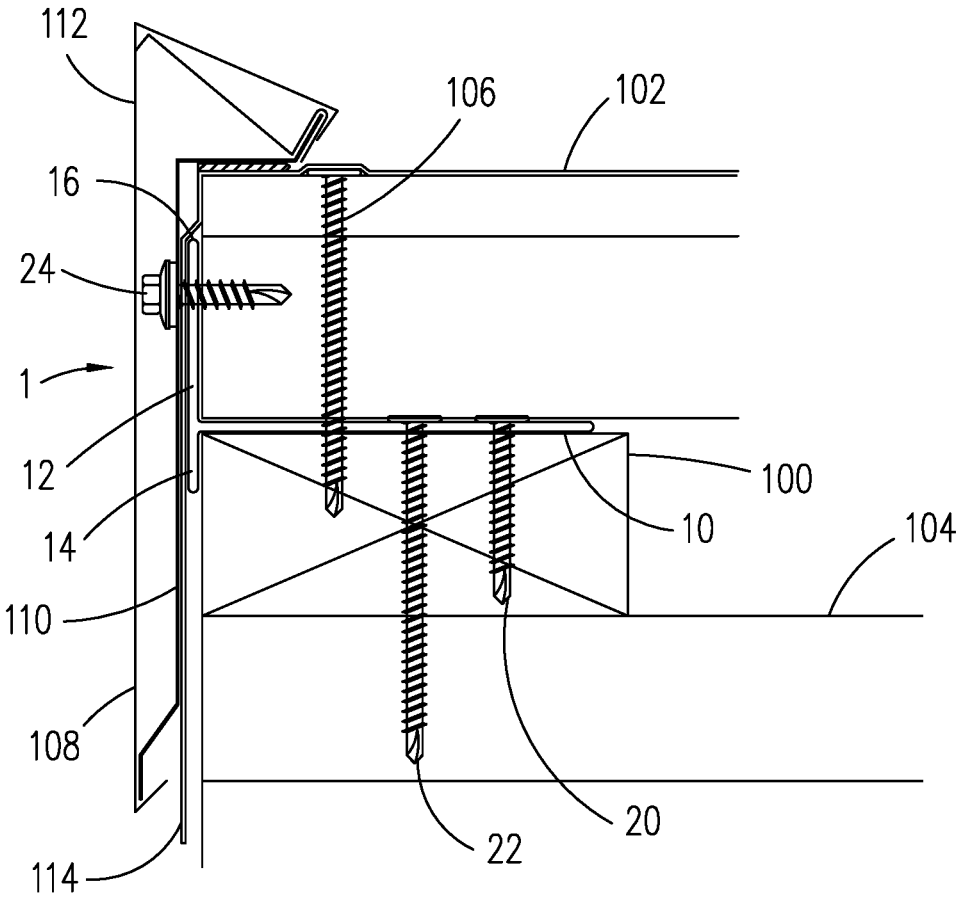
FIG. 3 is a cross sectional view of a roof edge mounting bracket attached to either a wood nailer or a corrugated metal deck, and fascia trim attached to the roof edge mounting bracket in accordance with the present invention.

With reference now to the drawings, and particularly to FIG. 2, there is shown a perspective view of a roof edge mounting bracket 1. With reference to FIGS. 1 and 3, the roof edge mounting bracket 1 preferably includes a base member 10 and a vertical attachment flange 12. The base member 10 extends outward in a horizontal orientation from the vertical attachment flange 12. A lower portion 14 of the vertical attachment flange 12 extends below the base member 10 and an upper portion 16 of the vertical attachment flange 12 extends above the base member 10. It is preferable that a height of the upper portion 16 is about at least 0.5 inches and the lower portion 14 is about 0.5 inches. If multiple layers of insulation are used, the upper portion 16 of the vertical attachment flange 12 will have to be greater than 0.5 inches. With reference to FIG. 1*a*, the lower portion 14' of the vertical attachment flange 12' may be equal in length, less in length or greater in length than the upper portion 16' of the vertical attachment flange 12' of a roof edge mounting bracket 1'.

Figure 1B:
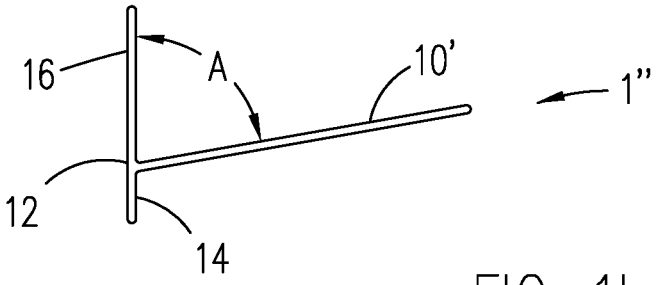
FIG. 1*b* is an end view of an angled roof edge bracket with a base member pointing upward in accordance with the present invention.
Figure 1C:
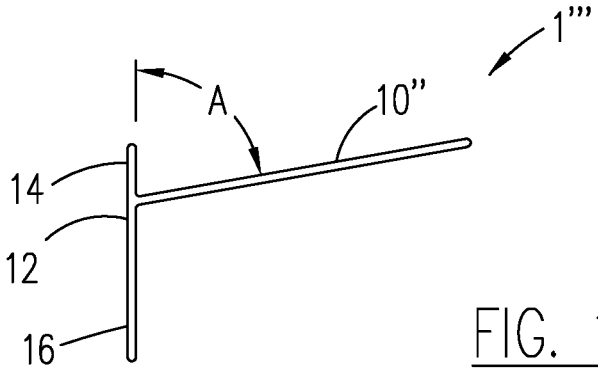
FIG. 1*c* is an end view of an angled roof edge bracket with a base member pointing downward in accordance with the present invention.
Figure 1D:
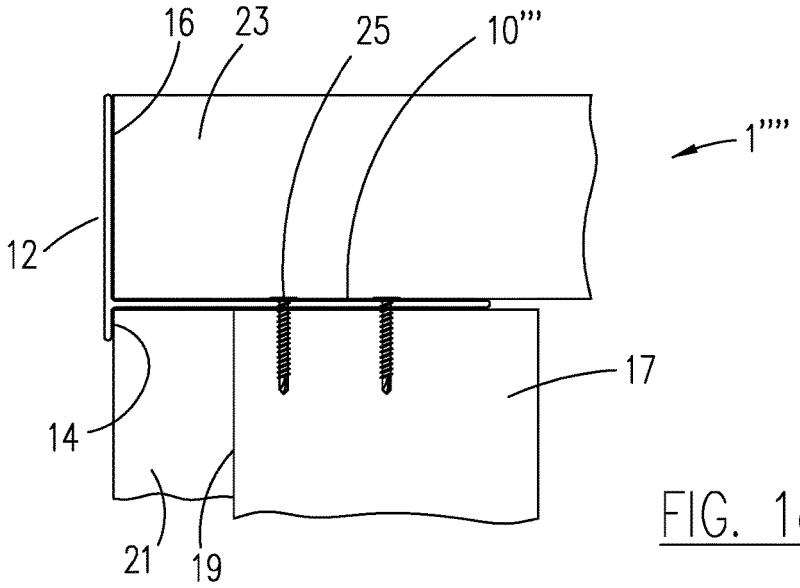
FIG. 1*d* is an end view of a cantilevered roof edge bracket, which provides clearance for a nonsupporting decorative panel in accordance with the present invention.

With reference to FIG. 1*b*, an angled roof edge bracket 1" includes a base member 10' and a vertical attachment flange 12. The base member 10' extends upward from the vertical attachment flange 12 at an acute angle A. With reference to FIG. 1*c*, an angled roof edge bracket 1'" includes a base member 10" and a vertical attachment flange 12. The base member 10" extends downward from the vertical attachment flange 12 at an acute angle A. With reference to FIG. 1*d*, a cantilevered roof edge bracket 1"" includes a cantilevered base member 10'" and the attachment flange 12. The vertical attachment flange 12 does not make contact with an outer surface 19 of a wall 17. The cantilevered base member 10'" does not make contact with the wall 17 to provide clearance for a non-supporting decorative panel 21 applied to the outer surface 19 of the wall 17. Insulation 23 is extended outward to the upper portion 16 of the vertical attachment flange 12. The cantilevered roof edge bracket 1"" is attached to a top of the wall 17 with a plurality of fasteners 25. A fascia bracket (not shown) is attachable to the vertical attachment flange 12. The insulation 23 may be replaced with cover board, or used in conjunction with cover board.

Figure 1E:
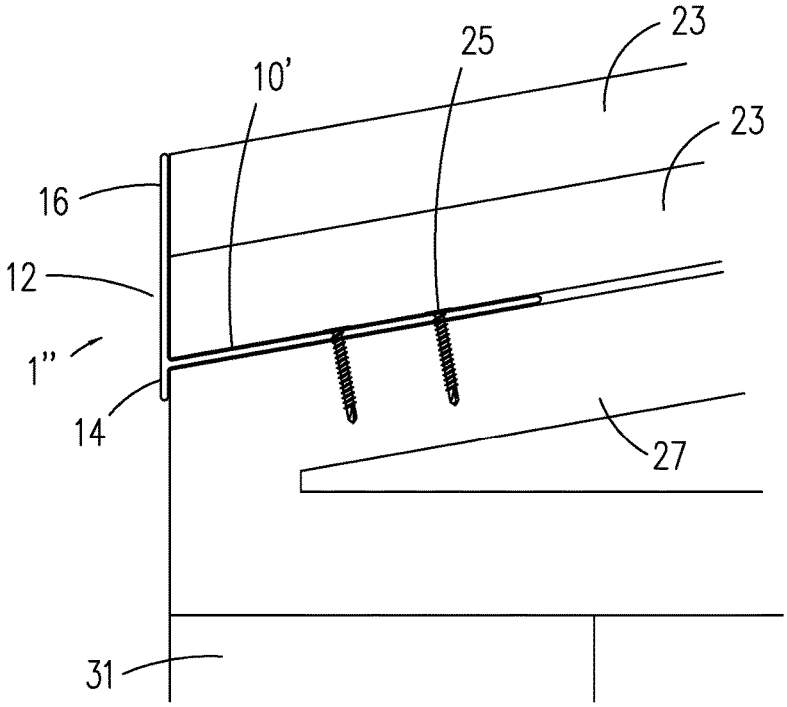
FIG. 1*e* is an end view of an angled roof edge bracket with a base member pointing upward attached to a sloped substrate of a building with a sloped roof in accordance with the present invention.

With reference to FIG. 1*e*, the angled roof edge bracket 1" is attached to a top of a sloped substrate 27 of a building with a sloped roof with the plurality of fasteners 25. At least one layer of insulation 23 is retained on the base member 10' and by the vertical attachment flange 12. The at least one layer of insulation 23 continues to an outer surface of a wall 31.

A plurality of staggered fastener openings 18 are preferably formed through the base member 10. The purpose of the staggered holes is to enable contractors to easily conform to insurance specifications. The roof edge mounting bracket 1 is preferably fabricated from an aluminum extrusion, but other materials and manufacturing processes may also be used. The base member 10 is inserted between a top of a wood nailer 100 and a bottom of an insulation board 102. The wood nailer 100 is mounted to a top of a corrugated metal deck 104. The roof edge mounting bracket 1 is secured to a building with a plurality of fasteners 20 inserted through the plurality of fastener openings 18 and fastened into the wood nailer 100 or a non-wood nailer. The plurality of fastener openings are preferably slots but could be any suitable shape. However, if the wood nailer 100 is damaged, longer fasteners 22 must be used, which will be fastened into the corrugated metal deck 104. The insulation board 102 is attached to the wood nailer with a plurality of fasteners 106. Fascia trim 108 includes a base portion 110 and a cover portion 112. The base portion 110 is attached to the top portion 16 of the vertical attachment flange 12 with a plurality of self-tapping fasteners 24. However, other designs of roof trim may also be used. A roof membrane 114 is laid over the insulation board 102 and located between the base portion 110 of the fascia trim 108 and the lower portion 14 of the vertical attachment flange 12.

Figure 4:
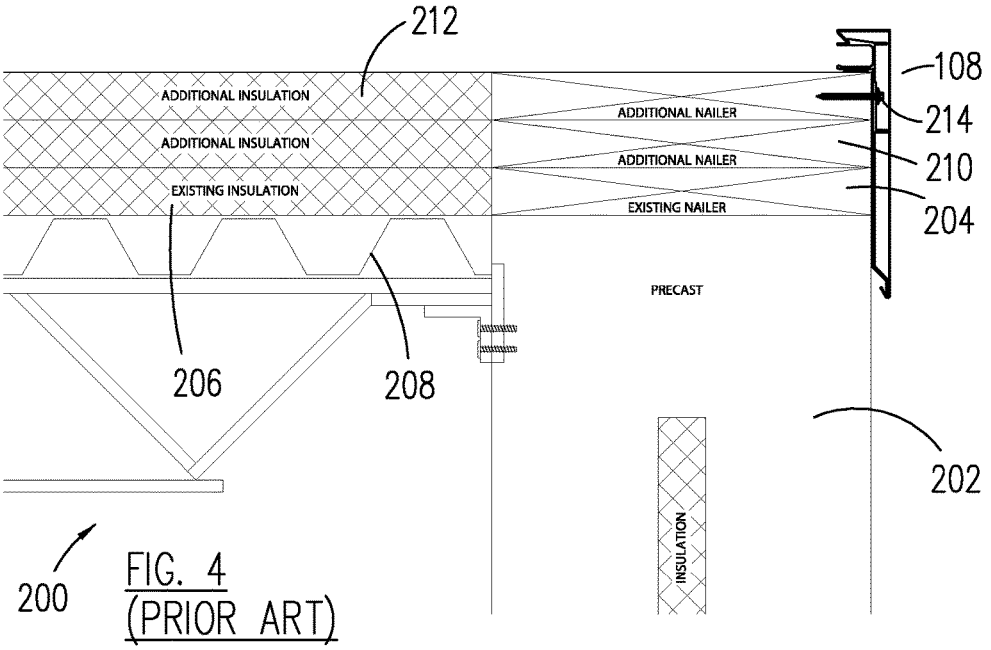
FIG. 4 (PRIOR ART)
FIG. 4 is a cross sectional view of a building with an existing wood nailer, two additional wood nailers, an existing insulation layer and two additional insulation layers with a fascia attached to a top one of the two additional wood nailers.

With reference to FIG. 4, in a prior art configuration, an existing wood nailer 204 is attached to a top of a pre-cast wall 202. An existing insulation layer 206 is placed over a roof 208 of a building 200, adjacent the existing wood nailer 204. Two additional wood nailers 210 are attached on top of the existing wood nailer 204 and two additional insulation layers 212 are attached to a top of the existing insulation layer 206. The fascia trim 108 is attached to a top one of the two additional wood nailers with fasteners 214.

Figure 5:
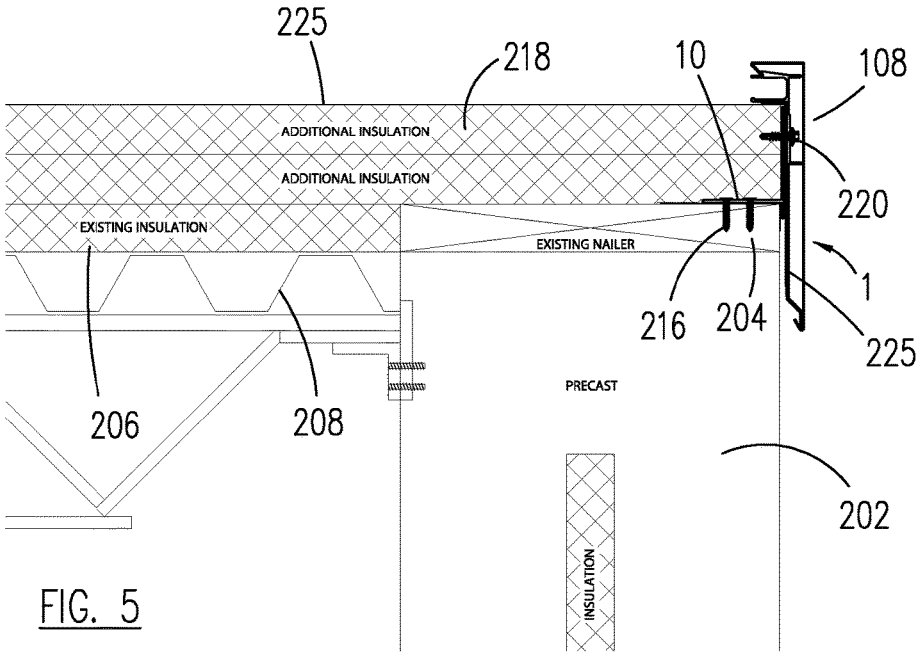
FIG. 5 is a cross sectional view of a building with an existing wood nailer, existing insulation layer and two extended, additional insulation layers with a fascia attached to a top of the existing wood nailer.

With reference to FIG. 5, the existing wood nailer 204 is attached to a top of the pre-cast concrete wall 202. The base member 10 of the roof edge mounting bracket 1 is secured to the top of the existing wood nailer 204 with a plurality of fasteners 216. The existing insulation 206 is placed over the existing roof 208. At least one layer of additional insulation 218 is placed over the existing insulation 206, the existing nailer 204 and the base member 10. The fascia trim 108 is secured to the upper portion 16 of the vertical attachment flange 12 of the roof edge mounting bracket 1 with a plurality of trim fasteners 220. A roof membrane 225 is preferably laid over a top of the additional insulation 218 and located between the base portion 110 of the fascia trim 108 and the lower portion 14 of the vertical attachment flange 12. The fascia trim 108 is capable of being attached to the upper portion 16 of the vertical attachment flange 12 at different heights relative to the base member 10.

Figure 6:
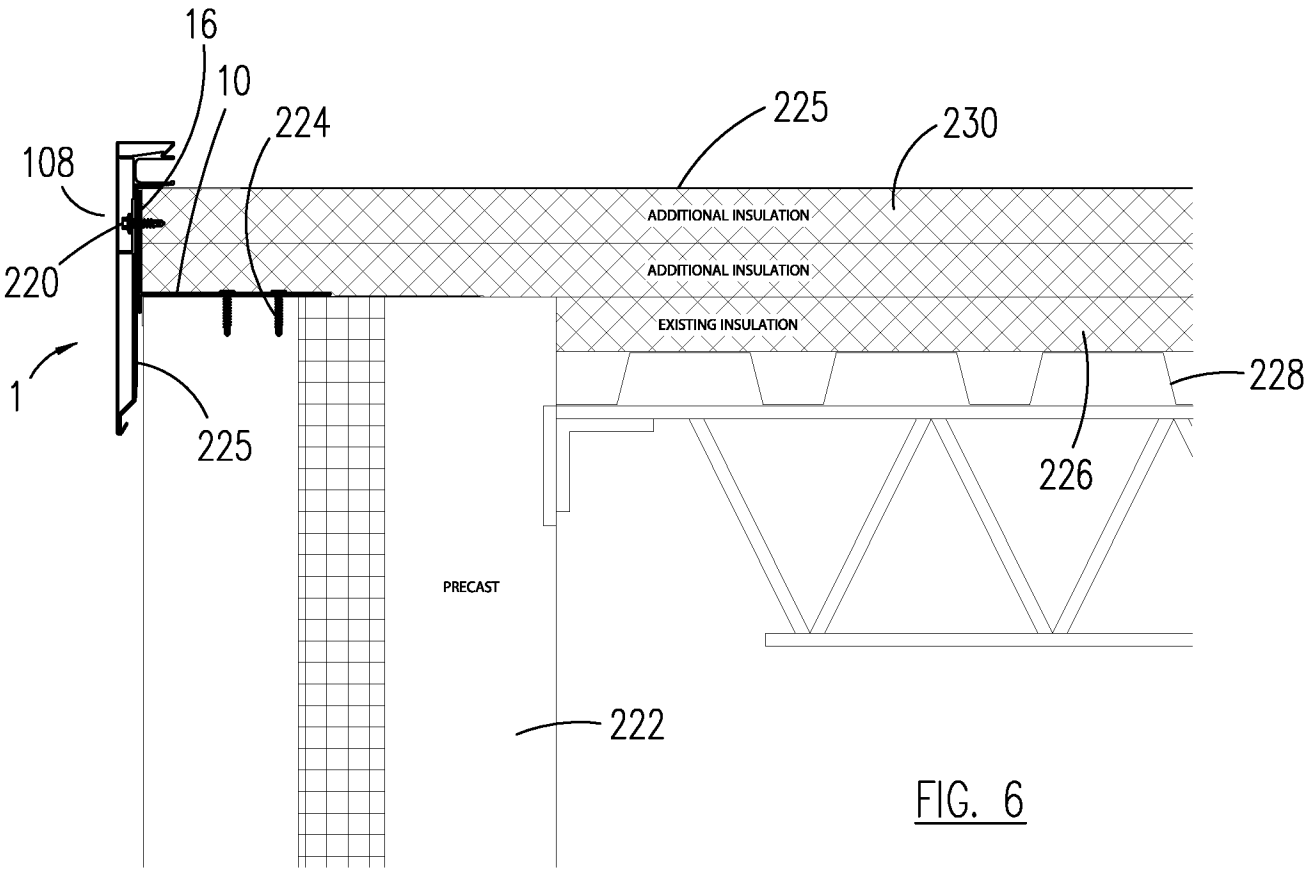
FIG. 6 is a cross sectional view of a building with a pre-cast concrete wall, existing insulation layer and two extended, additional insulation layers with a fascia attached to a top of the pre-cast concrete wall.

With reference to FIG. 6, the base member 10 of the roof edge mounting bracket 1 is secured to a top of a pre-cast concrete wall 222 with a plurality of fasteners 224. Existing insulation 226 is placed over an existing roof 228. At least one layer of additional insulation 230 is placed over the existing insulation 226, the pre-cast concrete wall 222 and the base member 10. The fascia trim 108 is secured to the upper portion 16 of the vertical attachment flange 12 of the roof edge mounting bracket 1 with a plurality of trim fasteners 220. A roof membrane 225 is preferably laid over a top of the additional insulation 230 and located between the base portion 110 of the fascia trim 108 and the lower portion 14 of the vertical attachment flange 12. The fascia trim 108 is capable of being attached to the upper portion 16 of the vertical attachment flange 12 at different heights relative to the base member 10.

Figure 7:
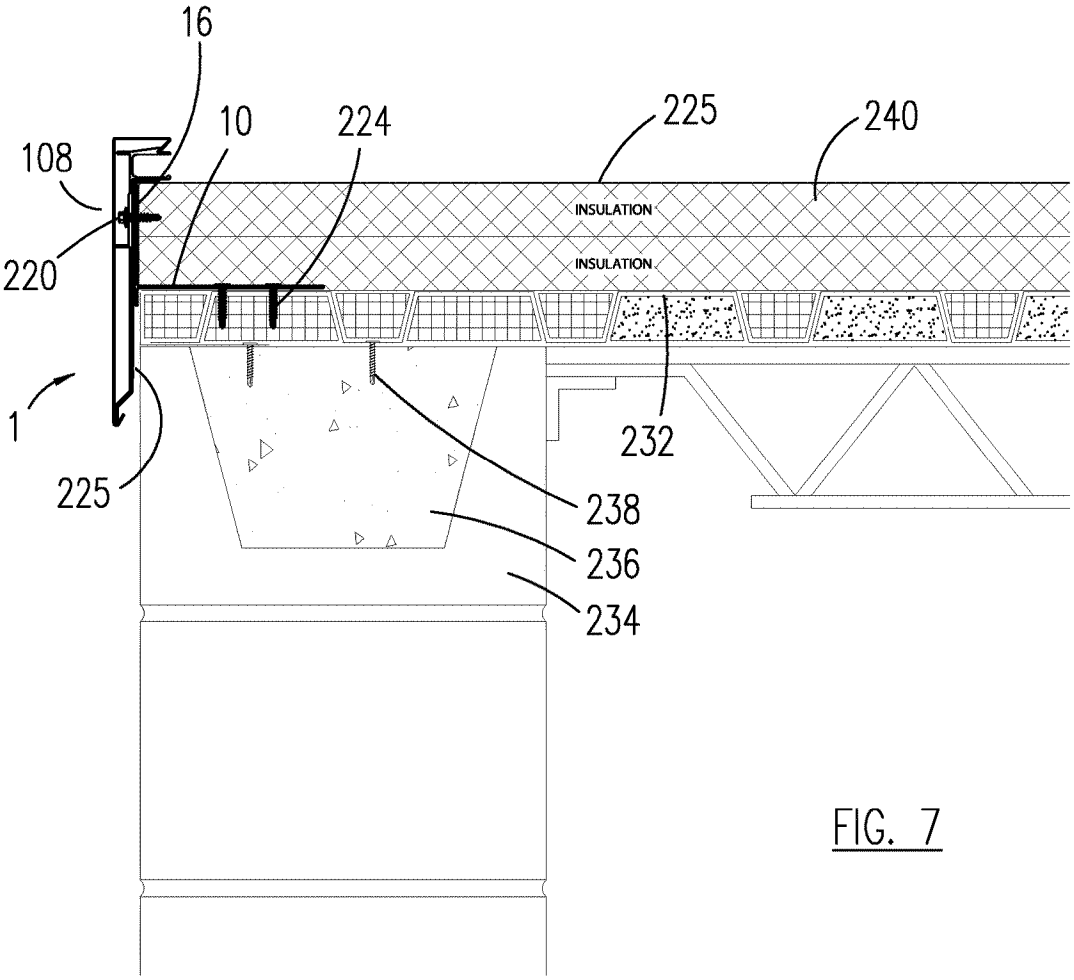
FIG. 7 is a cross sectional view of a building with a concrete block wall, a corrugated metal deck and two insulation layers with a fascia attached to a top of the corrugated metal deck.

With reference to FIG. 7, the base member 10 of the roof edge mounting bracket 1 is secured to a top of a corrugated metal deck 232 with a plurality of fasteners 224. The corrugated metal deck 232 is attached to a concrete insert 236 in a top of a concrete block 234 with a plurality of block fasteners 238. At least one layer of insulation 240 is placed over the corrugated metal deck 232 and the base member 10. The fascia trim 108 is secured to the upper portion 16 of the vertical attachment flange 12 of the roof edge mounting bracket 1 with a plurality of trim fasteners 220. A roof membrane 225 is preferably laid over a top of the at least one layer of insulation 240 and located between the base portion 110 of the fascia trim 108 and the lower portion 14 of the vertical attachment flange 12. The fascia trim 108 is capable of being attached to the upper portion 16 of the vertical attachment flange 12 at different heights relative to the base member 10.

Figure 8:
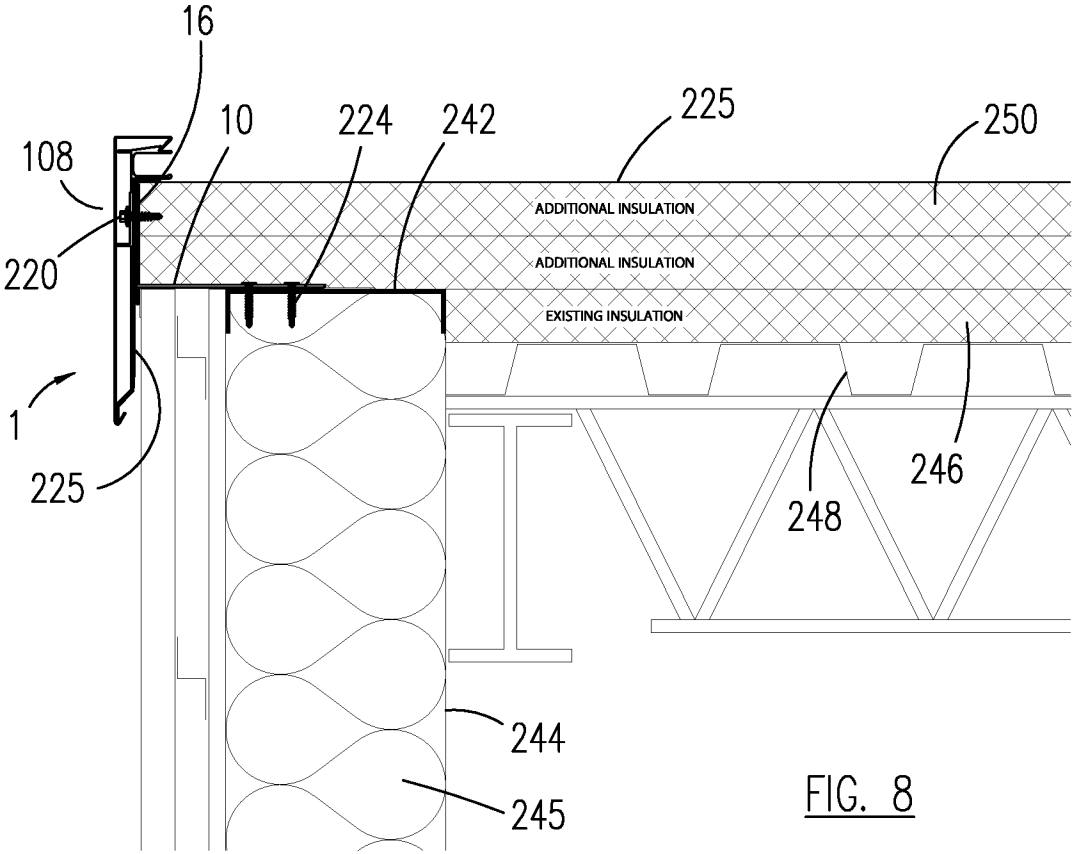
FIG. 8 is a cross sectional view of a building with a plurality of insulation filled metal stud walls, a cap channel, an existing layer of insulation, two additional insulation layers with a fascia attached to a top of the cap channel.

With reference to FIG. 8, the base member 10 of the roof edge mounting bracket 1 is secured to a top of a cap channel 242 with a plurality of fasteners 242, which terminates a top of a plurality of metal studs 244. Stud insulation 245 is placed within the plurality of metal studs 244. Existing insulation 246 is placed over an existing roof 248. At least one layer of additional insulation 250 is placed over the existing insulation 246, the cap channel 242 and the base member 10. The fascia trim 108 is secured to the upper portion 16 of the vertical attachment flange 12 of the roof edge mounting bracket 1 with a plurality of trim fasteners 220. A roof membrane 225 is preferably laid over a top of the at least one layer of additional insulation 250 and located between the base portion 110 of the fascia trim 108 and the lower portion 14 of the vertical attachment flange 12. The fascia trim 108 is capable of being attached to the upper portion 16 of the vertical attachment flange 12 at different heights relative to the base member 10.

Figure 9:
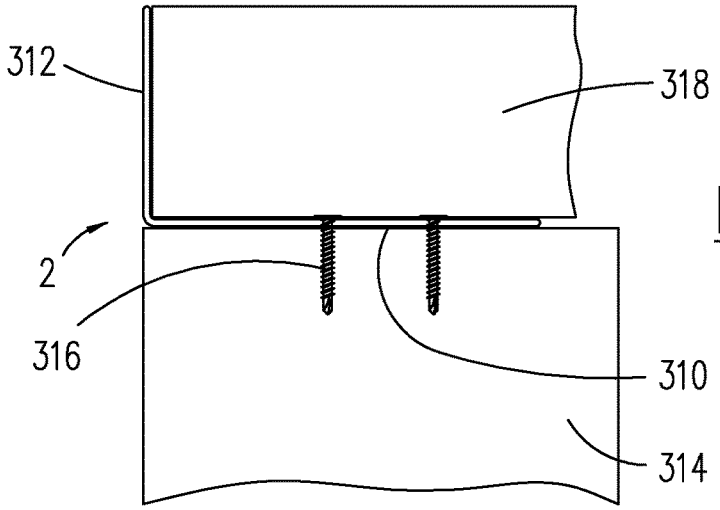
FIG. 9 is a cross sectional view of a roof edge angle bracket attached to a top of a wall in accordance with the present invention.

With reference to FIG. 9, a roof edge angle bracket 2 includes a base member 310 and a vertical attachment flange 312. The vertical attachment flange 312 extends upward from an end of the base member 310. The vertical attachment flange 312 does not include a lower portion. The base member 310 is attached to a top of a wall 314 with a plurality of fasteners 316. At least one layer of insulation 318 contacts an inside surface of the vertical attachment flange 312 and a top of the base member 310.

Figure 10:
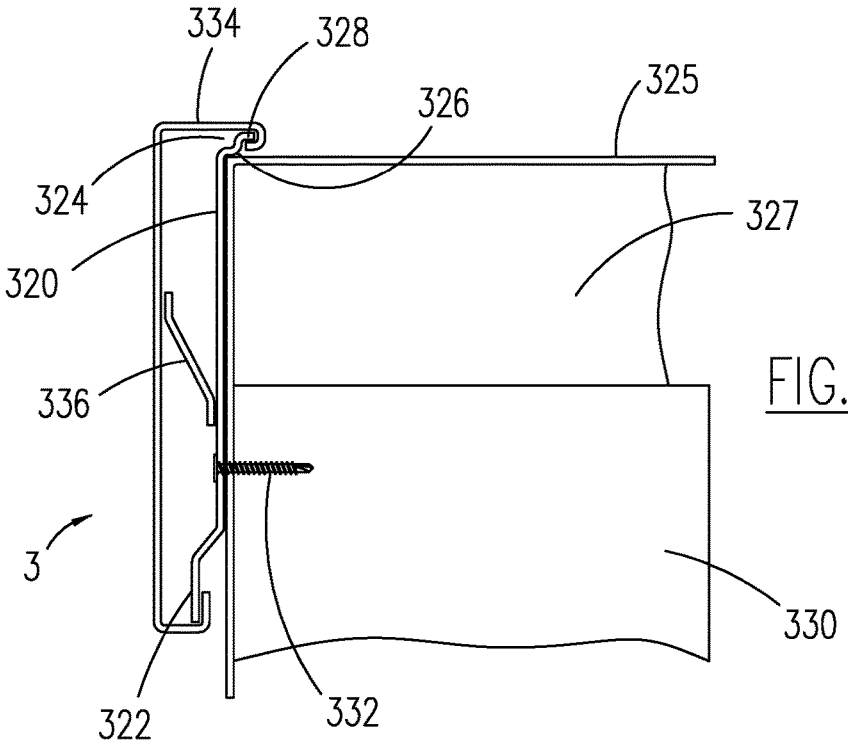
FIG. 10 is a cross sectional view of a vertical roof edge bracket attached to an outer surface of a wall in accordance with the present invention.
Figure 11:
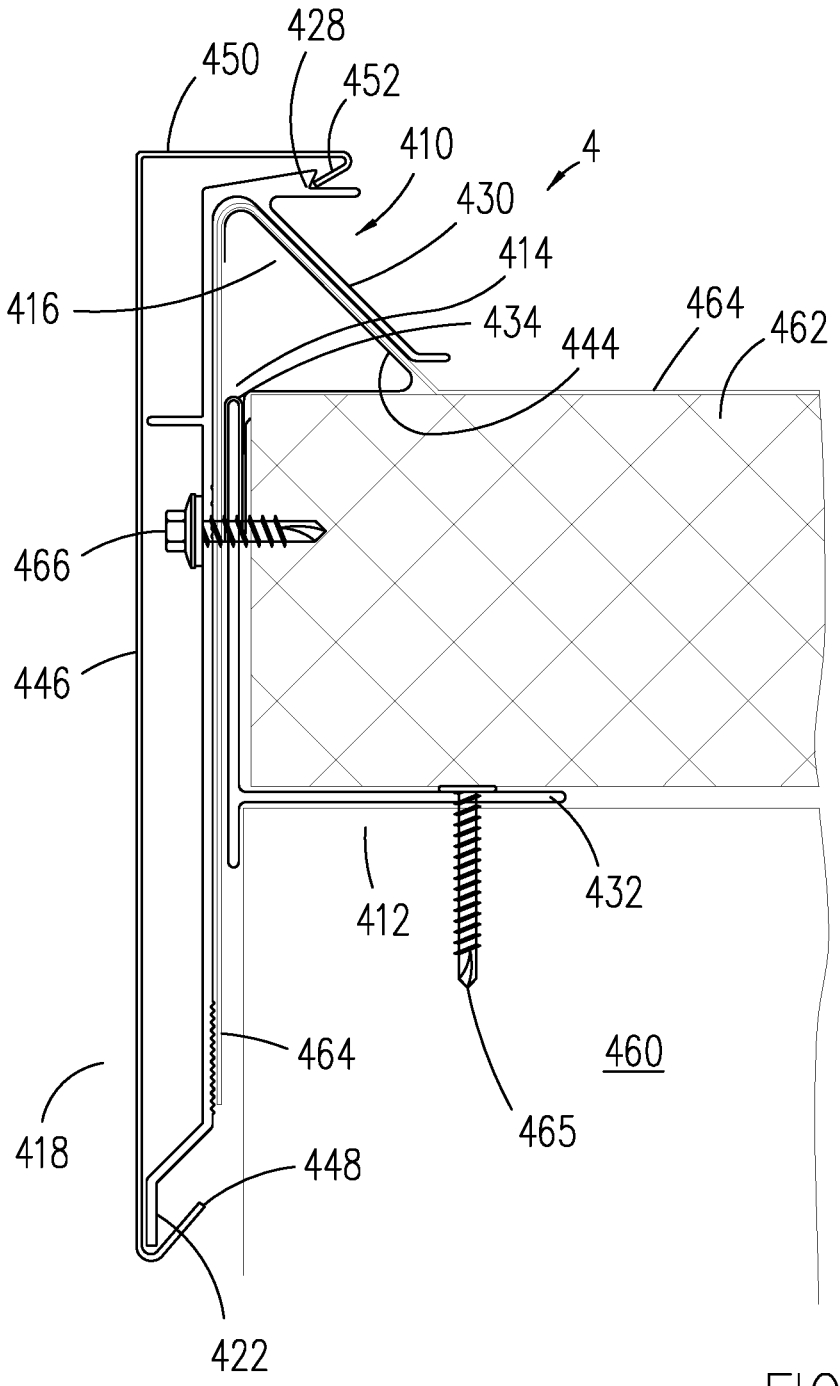
FIG. 11 is an end view of a canted fascia with roof edge bracket secured to a top of a wall in accordance with the present invention.
Figure 12:
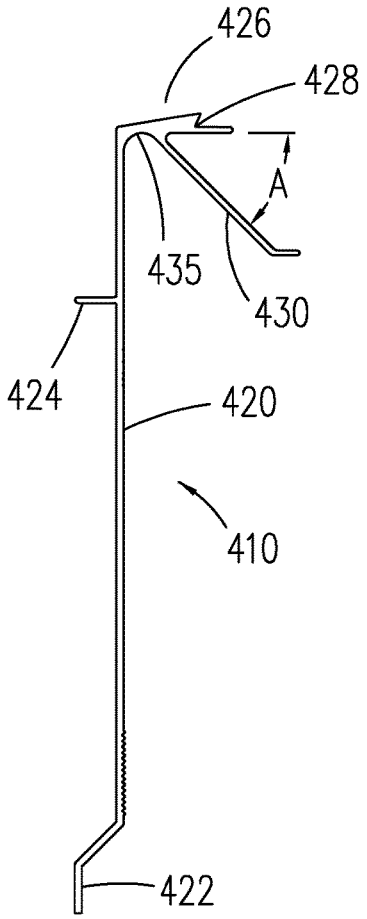
FIG. 12 is an end view of an anchor bar of a canted fascia with roof edge bracket in accordance with the present invention.
Figure 13:
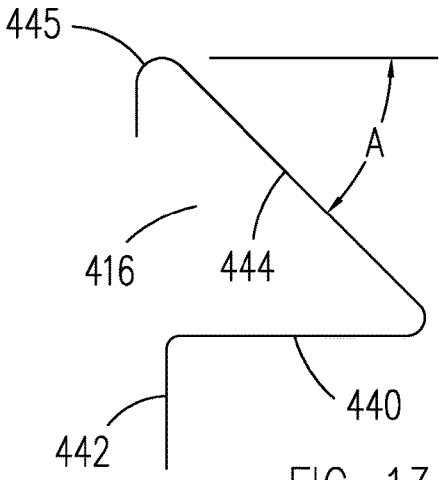
FIG. 13 is an end view of a water dam of a canted fascia with roof edge bracket in accordance with the present invention.
Figure 14:
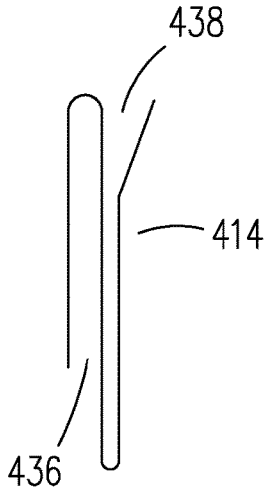
FIG. 14 is an end view of an S-clip of a canted fascia with roof edge bracket in accordance with the present invention.

With reference to FIG. 10, a roof edge vertical bracket 3 preferably includes a vertical attachment flange 320, a bottom offset lip 322 and an upper retaining lip 324. The bottom offset lip 322 extends from a bottom of the vertical attachment flange 320. The upper retaining lip 324 extends upward from a top of the vertical attachment flange 320. The upper retaining lip 324 includes a turned over lip 326 and a clip extension 328. The clip extension 328 extends from a top of the turned over lip 326. A roof membrane 325 is laid over the at least one layer of insulation 227 and an outside surface of a wall 330. The vertical attachment flange 320 is placed on the roof membrane 325 and attached to the wall 330 with a plurality of fasteners 332. A top and bottom of a fascia cover 334 is retained on the offset lip 322 and the clip extension 328. A spring clip 336 extending from an inside surface of the fascia cover 334 is used to lock the fascia cover on the roof edge vertical bracket 3.

With reference to FIGS. 11-14, a canted fascia with roof edge bracket (canted fascia) 4 preferably includes an anchor bar 410, a roof edge bracket 412, an S-clip 414, a water dam 416 and a fascia cover 418. The anchor bar 410 preferably includes a lengthwise base member 420, an offset end 422, a spacer projection 424 and an upper cover retainer 426. The offset end 422 extends from a bottom of the lengthwise base member 420. The spacer projection 424 extends outward from an outside surface of the lengthwise base member 420. The upper cover retainer 426 extends from a top of the lengthwise base member 420. The upper cover retainer 426 includes a cover groove 428 and a membrane projection 430. The membrane projection 430 extends downward at an acute angle "A" from the upper cover retainer 426. Angle "A" has a preferable value of about 45 degrees, but has a range of between 35-55 degrees. A curved junction 435 is preferably formed between the membrane projection 430 and the base member 420

The roof edge bracket 412 includes a base member (horizontal member) 432 and a vertical member 434. The base member 432 extends from the vertical member 434. The S-clip 414 includes a strip metal bent to form a downward facing pocket 436, adjacent an upward facing pocket 438. The water dam 416 includes a base portion 440, a vertical portion 442 and an angled portion 444. The vertical portion 442 extends downward from one end of the base portion 440. One end of the angled portion 444 extends upward from an opposing end of the base portion 440 at the acute angle "A". An opposing end of the angled portion 444 is preferably terminated with a curved end 445. The fascia cover 418 includes a fascia base 446, a bottom clip 448, a clip extension 450 and an upper clip 452. The bottom clip 448 extends upward and back from a bottom of the fascia base 446. One end of the clip extension 450 extends back from a top of the fascia base 446. The upper clip 452 extends downward and inward from an opposing end of the clip extension 450.

Figure 15:
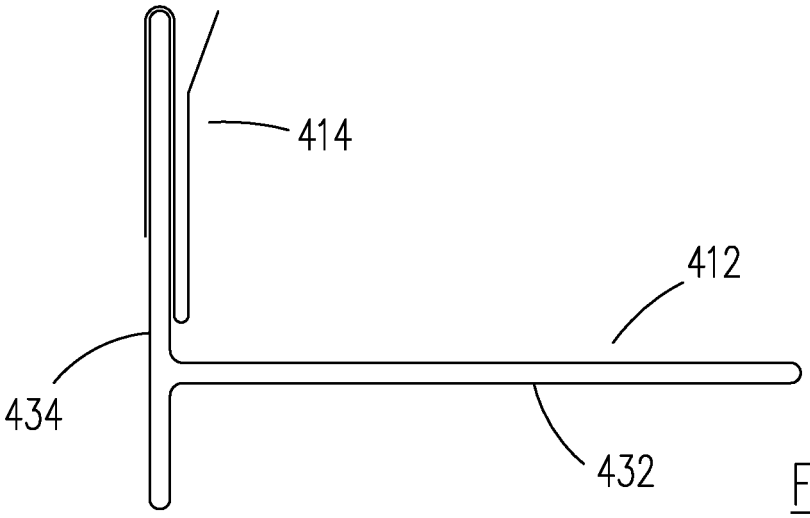
FIG. 15 is an end view of an S-clip retained on a vertical portion of a roof edge bracket of a canted fascia with roof edge bracket in accordance with the present invention.
Figure 16:
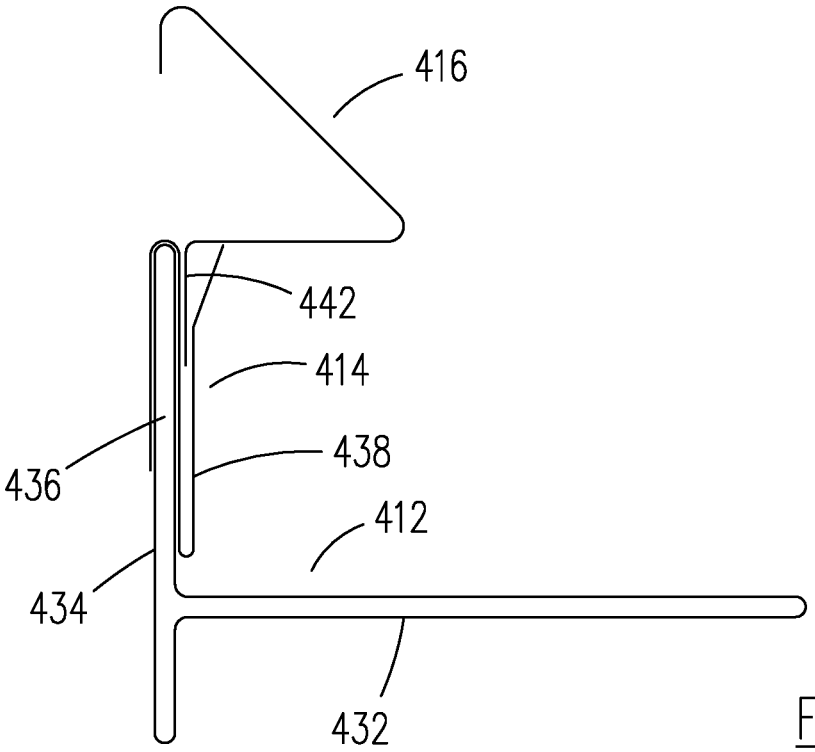
FIG. 16 is an end view of an S-clip retained on a vertical portion of a roof edge bracket and a water dam retained in the S-clip of a canted fascia with roof edge bracket in accordance with the present invention.

With reference to FIG. 15, the vertical member 434 of the roof edge bracket 412 is inserted into the downward facing pocket 436 of the S-clip 414. With reference to FIG. 15, the vertical portion 442 of the water dam 416 is inserted into the upward facing pocket 438 in the S-clip 414. The horizontal portion 432 of the roof edge bracket 412 is preferably secured to a top of a wall 460 with a plurality of fasteners 465. At least one insulation layer 462 is placed over the horizontal portion 432. A roof membrane 464 is laid over the at least one insulation layer 462 and the angled portion 444 of the water dam 416. The membrane projection 430 of the anchor bar 410 is placed over a top of the roof membrane 464. The lengthwise base member 420 is attached to the vertical portion 434 of the roof edge bracket 412 preferably with a plurality of fasteners 466. The fascia cover 418 is attached to the anchor bar 410 by placing the offset end 422 into the bottom clip 448. The fascia cover 418 is then rotated to insert the upper clip 452 into the cover groove 428 of the upper cover retainer 426.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A canted fascia with roof edge bracket for extending insulation over a top of a wall of a building, said roof edge bracket is attached to the top of the wall, comprising:

an anchor bar includes a lengthwise base member and an upper cover retainer, said upper cover retainer extends inward from a top of said lengthwise base member;

said roof edge bracket includes a vertical member and a base member which extends from said vertical member; and a water dam includes an angled portion and a vertical portion; and an S-clip retains said vertical member and said vertical portion, wherein said lengthwise base member of said anchor bar is secured to said vertical member of said roof edge bracket.

2. The canted fascia with roof edge bracket of claim 1, wherein:

an offset end is formed on a bottom of said lengthwise base member.

3. The canted fascia with roof edge bracket of claim 1, further comprising:

a fascia cover includes a fascia base, a bottom clip, a clip extension and an upper clip, said bottom clip extends upward from a bottom of said fascia base, one end of said clip extension extends back from a top of said fascia base, said upper clip extends downward from an opposing end of said clip extension.

4. The canted fascia with roof edge bracket of claim 1, wherein:

said lengthwise base member is attached to said vertical member with a plurality of fasteners.

5. The canted fascia with roof edge bracket of claim 1, wherein:

said water dam includes a base portion, said vertical portion extends downward from one end of said base portion, said angled portion extends upward from an opposing end of said base portion.

6. A canted fascia with roof edge bracket for extending insulation over a top of a wall of a building, said roof edge bracket is attached to the top of the wall, comprising:

an anchor bar includes a lengthwise base member and an upper cover retainer, said upper cover retainer extends inward from a top of said lengthwise base member;

said roof edge bracket includes a vertical member and a base member which extends from said vertical member;

a water dam includes an angled portion, a base portion and a vertical portion, said vertical portion extends downward from one end of said base portion, said angled portion extends upward at an acute angle from an opposing end of said base portion; and an S-clip retains said vertical member and said vertical portion, wherein said lengthwise base member of said anchor bar is attached to said vertical member of said roof edge bracket.

7. The canted fascia with roof edge bracket of claim 6, wherein:

an offset end is formed on a bottom of said lengthwise base member.

8. The canted fascia with roof edge bracket of claim 7, further comprising:

a fascia cover includes a fascia base, a bottom clip, a clip extension and an upper clip, said bottom clip extends upward from a bottom of said fascia base, one end of said clip extension extends back from a top of said fascia base, said upper clip extends downward from an opposing end of said clip extension.

9. The canted fascia with roof edge bracket of claim 6, wherein:

said lengthwise base member is attached to said vertical member with a plurality of fasteners.

10. The canted fascia with roof edge bracket of claim 6, wherein:

said S-clip includes a downward facing pocket adjacent an upward facing pocket, said downward facing pocket is sized to receive said vertical member, said upward facing pocket is sized to receive said vertical portion.

11. A canted fascia with roof edge bracket for extending insulation over a top of a wall of a building, said roof edge bracket is attached to the top of the wall, comprising:

an anchor bar includes a lengthwise base member, a membrane projection and upper cover retainer, said upper cover retainer extends inward from a top of said lengthwise base member, said membrane projection extends downward from said upper cover retainer;

said roof edge bracket includes a vertical member and a base member which extends from said vertical member;

a water dam includes an angled portion, a base portion and a vertical portion, said vertical portion extends downward from one end of said base portion, said angled portion extends upward at an acute angle from an opposing end of said base portion; and an S-clip retains said vertical member and said vertical portion, wherein a roof membrane is placed between said membrane projection and said angled portion, said lengthwise base member of said anchor bar is attached to said vertical member of said roof edge bracket.

12. The canted fascia with roof edge bracket of claim 11, wherein:

an offset end is formed on a bottom of said lengthwise base member.

13. The canted fascia with roof edge bracket of claim 11, further comprising:

a fascia cover includes a fascia base, a bottom clip, a clip extension and an upper clip, said bottom clip extends upward from a bottom of said fascia base, one end of said clip extension extends back from a top of said fascia base, said upper clip extends downward from an opposing end of said clip extension.

14. The canted fascia with roof edge bracket of claim 11, wherein:

said lengthwise base member is attached to said vertical member with a plurality of fasteners.

* * * * *